US010896660B2

(12) United States Patent
Kambe et al.

(10) Patent No.: US 10,896,660 B2
(45) Date of Patent: Jan. 19, 2021

(54) DISPLAY CONTROL DEVICE, DISPLAY DEVICE, AND DISPLAY CONTROL METHOD

(71) Applicant: SHARP KABUSHIKI KAISHA, Sakai (JP)

(72) Inventors: Tatsuya Kambe, Sakai (JP); Shigeru Ideue, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/394,669

(22) Filed: Apr. 25, 2019

(65) Prior Publication Data

US 2019/0333477 A1 Oct. 31, 2019

(30) Foreign Application Priority Data

Apr. 27, 2018 (JP) ..... 2018-087657

(51) Int. Cl.
*G09G 5/36* (2006.01)

(52) U.S. Cl.
CPC ..... *G09G 5/363* (2013.01)

(58) Field of Classification Search
CPC ..... G09G 2340/0435; G09G 2360/18; G09G 5/393; G09G 2310/08; G09G 3/36; G09G 2310/0202; G09G 2320/0257; G09G 2360/127; G09G 2370/08; G09G 3/14
See application file for complete search history.

(56) References Cited

U.S. PATENT DOCUMENTS

2002/0015016 A1 2/2002 Kudo et al.
2015/0235343 A1* 8/2015 Asai ..... G09G 5/18 345/534
2017/0352320 A1* 12/2017 Lin ..... G09G 3/3677
2018/0286312 A1* 10/2018 Lin ..... G09G 3/325

FOREIGN PATENT DOCUMENTS

JP 2010-170144 A 8/2010

* cited by examiner

*Primary Examiner* — Hau H Nguyen
(74) *Attorney, Agent, or Firm* — ScienBiziP, P.C.

(57) ABSTRACT

According to the present invention, it is possible to (i) prevent a deterioration in display quality caused by a disagreement between a frame interval of content and an interval for updating drawing, and (ii) carry out update of drawing quickly after receipt of a drawing update request. The drawing control section sets a first drawing period and a drawing update waiting period so that the periods become different in length and a combined length of those periods matches a frame interval of content.

13 Claims, 7 Drawing Sheets

DISPLAY CONTROL DEVICE, DISPLAY DEVICE, AND DISPLAY CONTROL METHOD

This Nonprovisional application claims priority under 35 U.S.C. § 119 on Patent Application No. 2018-087657 filed in Japan on Apr. 27, 2018 the entire contents of which is hereby incorporated by reference.

TECHNICAL FIELD

The present invention relates to a display control device, a display device, and a display control method.

BACKGROUND ART

A general display device, such as a liquid crystal display device, is driven at a constant driving frequency (e.g., 60 Hz). However, in recent years, there have been demands to drive the display device at various driving frequencies.

In a liquid crystal display control device disclosed in Patent Literature 1, when an image is displayed on an arbitrary partial region of a display screen in response to a request made by an application, a reference clock is generated by dividing an original clock, which has been generated by a reference clock generating section, with a frequency division ratio corresponding to the number of lines to be driven, and the reference clock is inputted to a timing generating section. In Patent Literature 1, this allows the liquid crystal panel to be driven at an intended frequency. Therefore, even in a case where the number of driven lines of the liquid crystal panel varies, i.e., even in a case where a size of a region for displaying an image on the liquid crystal panel varies, a frequency can be kept substantially constant.

CITATION LIST

Patent Literature

Patent Literature 1: Japanese Patent Application Publication, Tokukai, No. 2010-170144 (Publication Date: Aug. 5, 2010)

SUMMARY OF INVENTION

Technical Problem

Unlike a case where a video is displayed on a display screen, in a case where a still image is displayed on a display screen, an update interval of the image is wider. According to the technique of Patent Literature 1, the liquid crystal panel is driven at a constant frequency. Therefore, even in a case where a drawing update request is outputted from a host side at a frequency that is faster than a currently set constant frequency in the liquid crystal panel, the drawing can only be updated at a currently set frequency interval. Moreover, in a case where a frame interval of content to be displayed does not match a frequency of updating drawing of the liquid crystal display, a dropped frame occurs in the display, and this leads to a deterioration in display quality.

An object of an aspect of the present invention is to provide a display control device that (i) prevents a deterioration in display quality caused by a disagreement between a frame interval of content and an interval for updating drawing, and (ii) carries out update of drawing quickly after receipt of a drawing update request.

Solution to Problem

In order to attain the object, a display control device in accordance with an aspect of the present invention is a display control device for controlling a display panel which displays an image that is contained in content and is drawn, the display control device including: a drawing control section that sets a first drawing period and a drawing update waiting period, the first drawing period being a period during which the image is drawn, and the drawing update waiting period being a period following the first drawing period and being a period for waiting for update of drawing of the image, the drawing control section setting the first drawing period and the drawing update waiting period so that the first drawing period becomes different in length from the drawing update waiting period and, a frame interval of the content matches a combined period of the first drawing period and the drawing update waiting period.

In order to attain the object, a display control method in accordance with an aspect of the present invention is a method for causing a display control device to control a display panel which displays an image that is contained in content and is drawn, the method including: a drawing control step of setting a first drawing period and a drawing update waiting period, the first drawing period being a period during which the image is drawn, and the drawing update waiting period being a period following the first drawing period and being a period for waiting for update of drawing of the image, in the drawing control step, the first drawing period and the drawing update waiting period being set so that the first drawing period becomes different in length from the drawing update waiting period, and a frame interval of the content matches a combined period of the first drawing period and the drawing update waiting period.

Advantageous Effects of Invention

According to an aspect of the present invention, it is possible to provide a display control device that (i) prevents a deterioration in display quality caused by a disagreement between a frame interval of content and an interval for updating drawing, and (ii) carries out update of drawing quickly after receipt of a drawing update request.

DESCRIPTION OF EMBODIMENTS

Embodiment 1

Figure 1:
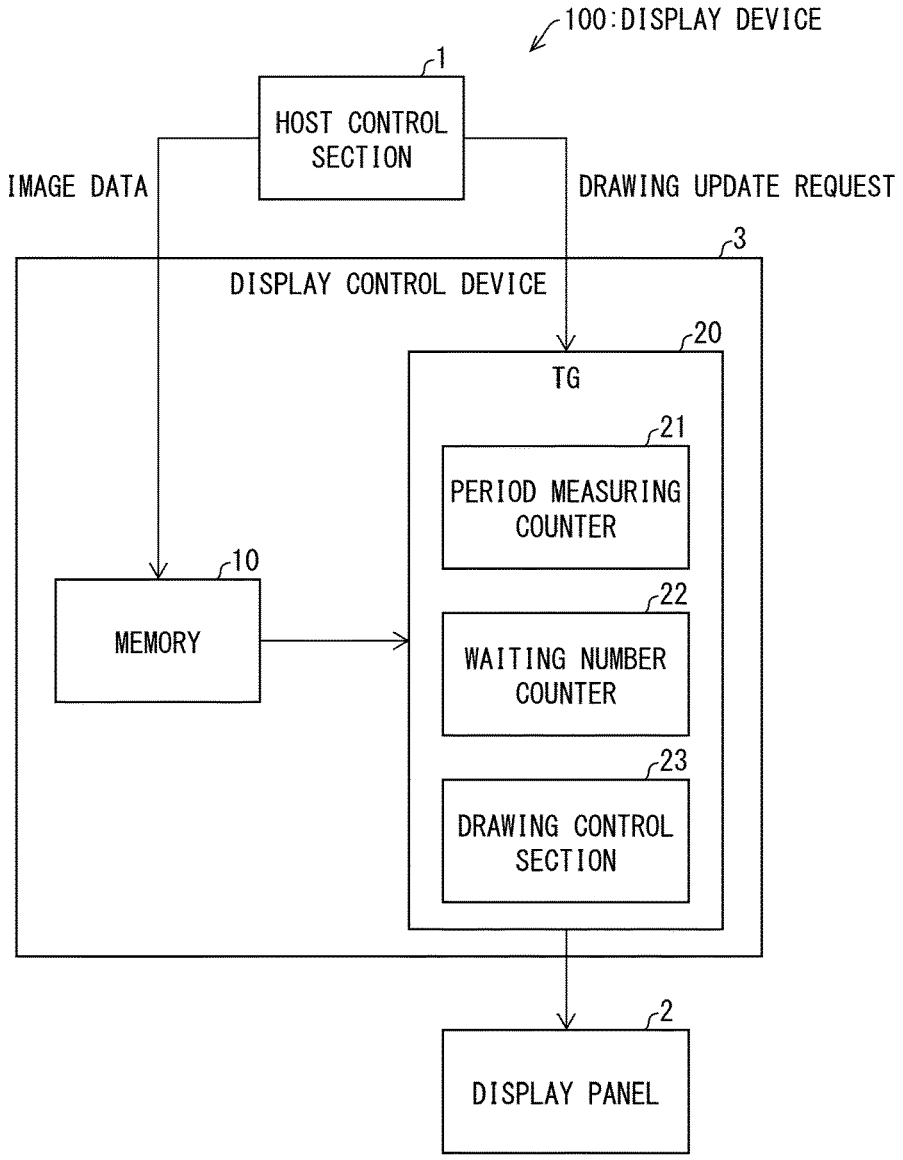
FIG. 1 is a view illustrating a main part configuration of a display device in accordance with Embodiment 1.

FIG. 1 is a view illustrating a main part configuration of a display device 100 in accordance with Embodiment 1. As illustrated in FIG. 1, the display device 100 includes a host control section 1, a display control section (display control device) 3, and a display panel 2. The display control section includes a memory (storage section) 10 and a timing generator (TG) 20. Suitable examples of the display device 100 include, for example, various electronic apparatuses each having a display screen, such as a mobile phone, a smart phone, a notebook PC, a tablet device, an electric book reader, and a PDA.

(Configuration of Host Control Section 1)

The host control section 1 obtains or generates image data to be displayed on the display panel 2, and transfers the image data to the display control section 3. The host control section 1 also transmits a drawing update request to the display control section 3 either with the image data or separately from the image data. The drawing update request is an instruction that causes the display panel 2 to display the image data. A format of image data is not particularly limited, provided that the display panel 2 can display the image data in that format.

The host control section 1 is a control circuit provided on a substrate, and at least part of the host control section 1 can be embodied by using a CPU, a memory, and the like. The host control section 1 is primarily carries out control on a host side of the display device 100 (e.g., control for a mobile terminal).

The host control section 1 generates image data to be displayed on a display screen of the display panel 2. The host control section 1 sequentially supplies pieces of image data of respective frames to the display control section 3 in accordance with a frame rate of content to be reproduced. In addition, the host control section 1 sequentially supplies drawing update requests, each of which is an instruction for causing the display panel 2 to display image data, to the display control section 3 in accordance with the frame rate of the content to be reproduced.

(Display Panel 2)

The display panel 2 includes a display screen having a plurality of pixels, a source driver, a gate driver, and the like. As the display panel 2, it is possible to employ, for example, an oxide semiconductor display panel that serves as an active matrix display panel. The oxide semiconductor display panel is a display panel in which an oxide semiconductor thin film transistor (TFT) is employed in a switching element that is provided for every at least one of the plurality of pixels arranged two-dimensionally. The oxide semiconductor TFT is a TFT in which an oxide semiconductor is used as a semiconductor layer. Examples of the oxide semiconductor include an oxide semiconductor (InGaZnO-based oxide semiconductor) containing oxides of indium, gallium, and zinc.

The oxide semiconductor TFT has (i) a large current that flows in an ON state and (ii) a low leakage current in an OFF state. Therefore, the switching element made up of the oxide semiconductor TFT makes it possible to improve a pixel aperture ratio and to reduce a refresh rate of an image displayed on the display screen to approximately 1 Hz.

The reduction of the refresh rate brings about a power saving effect. Note that the improvement in pixel aperture ratio leads to an effect of brightening the display. Alternatively, in a case where brightness of the display is set to be the same level as an amorphous silicon display panel or the like, a power saving effect is brought about by lowering light intensity of a backlight.

Here, a display element of a pixel is described as a liquid crystal display element. Note, however, that it is possible to employ a display element (such as an organic electroluminescence (EL) display element) other than the liquid crystal display element. In a case where the display panel 2 is a liquid crystal display panel, the display device 100 includes a backlight (not illustrated) on the back of the display panel 2.

(Display Control Section 3)

The display control section 3 drives the display panel 2 based on an instruction given from the host control section 1. The timing generator (TG) 20 is a circuit for outputting image data to the display panel 2 at a predetermined point in time, upon receipt of the image data and a drawing update request from the host control section 1. The TG 20 generates (i) a timing signal (such as a source clock pulse, a gate start pulse, or a gate clock pulse) for driving the display panel 2 and (ii) a data signal (which is source signal data representing an image), and outputs the timing signal and the data signal to the display panel 2.

The TG 20 includes a period measuring counter 21, a waiting number counter 22, and a drawing control section 23. The period measuring counter 21 measures and outputs, by counting the number of clocks, a period for generating various kinds of signals (such as the timing signal) which are outputted by the TG 20.

The drawing control section 23 adjusts a minimum unit period. This minimum unit period is a minimum time interval for confirming whether or not the drawing control section 23 has received a drawing update request from the host control section 1. In Embodiment 1, the minimum unit period is also a minimum unit of a time interval at which the drawing control section 23 updates drawing of an image displayed on the display screen of the display panel 2. The drawing control section 23 adjusts and manages a plurality of minimum unit periods based on an output from the period measuring counter 21.

As described later, the drawing control section 23 sets a drawing update waiting period by combining the drawing period and the drawing update waiting period based on the output of the period measuring counter 21 such that the drawing update waiting period matches the frame interval of content that is reproduced by the display device 100. The drawing period is a period during which the display panel 2 draws an image based on an instruction given from the TG 20. The drawing update waiting period is a period following the drawing period, and is a period for waiting for update of drawing of an image (i.e., a period during which an image is not drawn). The drawing update waiting period may be further divided into a plurality of minimum unit periods.

The waiting number counter 22 counts the number of times of minimum unit periods that elapse without update of drawing on the display screen. The number of times of minimum unit periods that elapse without update of drawing on the display screen is the number of times by which the drawing update waiting period elapses. Alternatively, in a case where the drawing update waiting period is divided into a plurality of minimum unit periods, the number of times of minimum unit periods that elapse without update of drawing on the display screen is the number of times by which each of the plurality of minimum unit periods elapses.

In a case where a value of the waiting number counter 22 has reached a predetermined value, the drawing control section 23 carries out update of drawing of the image displayed on the display screen. Thus, the image on the display panel 2 is updated at a minimally needed refresh rate (e.g., 1 Hz).

The memory 10 stores image data transferred from the host control section 1. The memory 10 keeps retaining display data until next update of display is carried out (i.e., unless contents of the image change).

Note that it is possible to employ a configuration in which the host control section 1 has a part of configuration of the display control section 3 (e.g., at least part of the memory area of the memory 10, the waiting number counter, and/or the like) so as to execute one or some functions of the display control section 3.

(Update of Drawing in Comparative Example 1)

Figure 2:
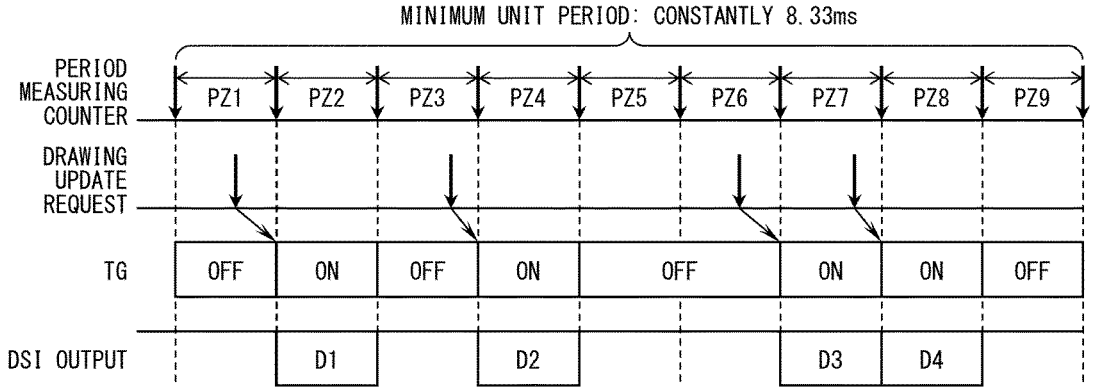
FIG. 2 is a view showing a timing diagram of update of drawing on a display device in accordance with Comparative Example 1.

FIG. 2 is a view showing a timing diagram of update of drawing on a display device in accordance with Comparative Example 1. The display device in accordance with Comparative Example 1 differs from the display device 100 in operation of the TG. The other configurations of the display device of Comparative Example 1 are similar to those of the display device 100.

In the display device in accordance with Comparative Example 1 illustrated in FIG. 2, it is assumed that the display control section drives the display panel at a constant driving frequency of 120 Hz. In this case, a minimum unit period of a driving period in which the display control section in accordance with Comparative Example 1 drives the display panel is constantly 8.33 ms. These consecutive minimum unit periods are, in order, a period PZ1, a period PZ2, . . . , a period PZ9, and so forth.

The display control section checks, for each minimum unit period, whether or not the display control section has received a drawing update request from the host. Each of the period PZ1, the period PZ2, . . . , the period PZ9, and so forth is measured by a period measuring counter included in a TG that is provided in the display control section in accordance with Comparative Example 1.

The TG in accordance with Comparative Example 1 checks, for each minimum unit period of 8.33 ms, whether or not the TG has received a drawing update request from the host control section. In a case where the TG has not received a drawing update request from the host control section during the minimum unit period of 8.33 ms, the TG checks again whether or not the TG has received a drawing update request from the host control section after the minimum unit period of 8.33 ms has elapsed.

That is, in a case where the TG has received a drawing update request from the host control section during the period PZ1, the TG recognizes that the TG has received the drawing update request after the elapse of the period PZ1. In the case where the TG has recognized that the TG has received the drawing update request, the TG enters an ON state in the following period PZ2, and the TG reads image data from the memory and generates a timing signal. Then, the TG outputs the image data which has been read and the timing signal to the display panel. Note that the period in which the TG outputs the image data to the display panel is referred to as a period of display serial interface (DSI) output. From this, the display panel receives the timing signal and the image data, and the display panel updates the image on the display screen to an image D1. Thus, the display panel completes the drawing of the image on the display screen.

Then, after the period PZ2 has elapsed, the TG checks whether or not the TG has received a drawing update request during the period PZ2. The TG has not received a drawing update request during the period PZ2, and therefore the TG sets a period PZ3 after the elapse of the period PZ2, and the TG enters an OFF state. That is, the TG neither generates a timing signal nor reads image data from the memory.

Subsequently, the TG similarly checks, for each constant minimum unit period of 8.33 ms, whether or not the TG has received a drawing update request from the host control section. Upon receipt of a drawing update request from the host control section during the minimum unit period, the TG enters the ON state during a next minimum unit period of the minimum unit period during which the TG has received the drawing update request. Thus, the display panel updates drawing of the image.

In the example shown in FIG. 2, the TG receives the drawing update requests during the periods PZ1, PZ3, PZ6, and PZ7, respectively, and the display panel updates the drawn image to images D1, D2, D3, and D4 in the respective periods PZ2, PZ4, PZ7, and PZ8 which are respectively subsequent to the periods PZ1, PZ3, PZ6, and PZ7.

Figure 3:
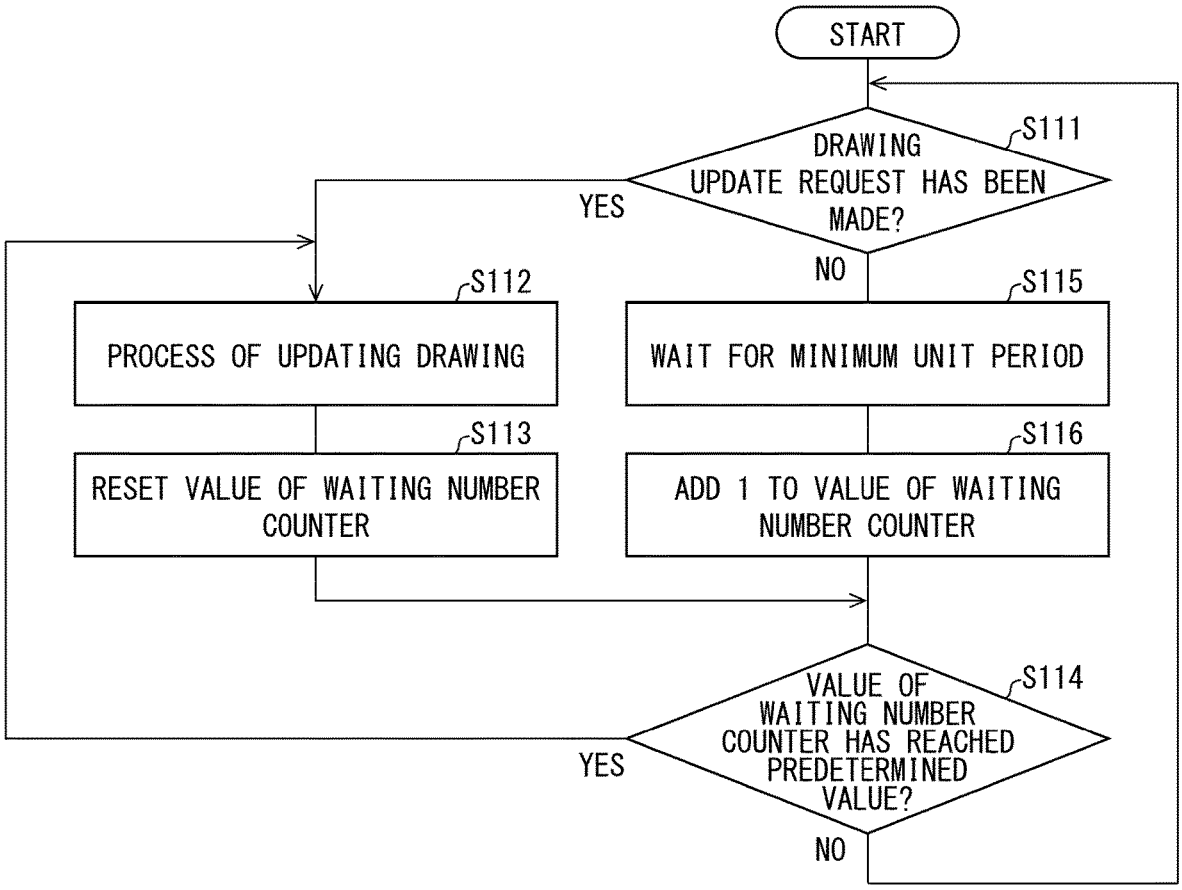
FIG. 3 is a view showing a flowchart of update of drawing on the display device in accordance with Comparative Example 1.

FIG. 3 is a view showing a flowchart of update of drawing on the display device in accordance with Comparative Example 1. As shown in FIG. 3, after the minimum unit period has elapsed, the TG included in the display device in accordance with Comparative Example 1 determines whether or not there is a drawing update request from the host control section (step S111).

In the step S111, in a case where the TG has determined that there is a drawing update request (Yes in step S111), the TG carries out a process of updating drawing in the following minimum unit period (step S112). Then, the TG resets the value of the waiting number counter included in the TG (step S113).

The TG then determines whether or not the value of the waiting number counter has reached a predetermined value (step S114). In the step S114, in a case where the TG has determined that the value of the waiting number counter has reached the predetermined value (Yes in step S114), the TG carries out the process of the step S112. In the step S114, in a case where the TG has determined that the value of the waiting number counter has not reached the predetermined value (No in step S114), the TG carries out the process of the step S111.

In the step S111, in a case where the TG has determined that there is no drawing update request (No in step S111), the TG waits for the following minimum unit period (step S115). The TG then adds 1 to the value of the waiting number counter (step S116). Then, the TG carries out the process of the step S114.

Thus, according to the display device in accordance with Comparative Example 1, since the minimum unit period is constantly 8.33 ms, a time lag from when the drawing update request has been sent from the host control section to the TG to when the update of drawing is carried out is up to 8.33 ms. Moreover, according to the display device in accordance with Comparative Example 1, in a case where the frame interval of content to be reproduced is not an integral multiple of 8.33 ms which is the minimum unit period, a non-displayed image (so-called dropped frame) occurs, and this leads to a deterioration in display quality.

(Update of drawing in Comparative Example 2)

Figure 4:
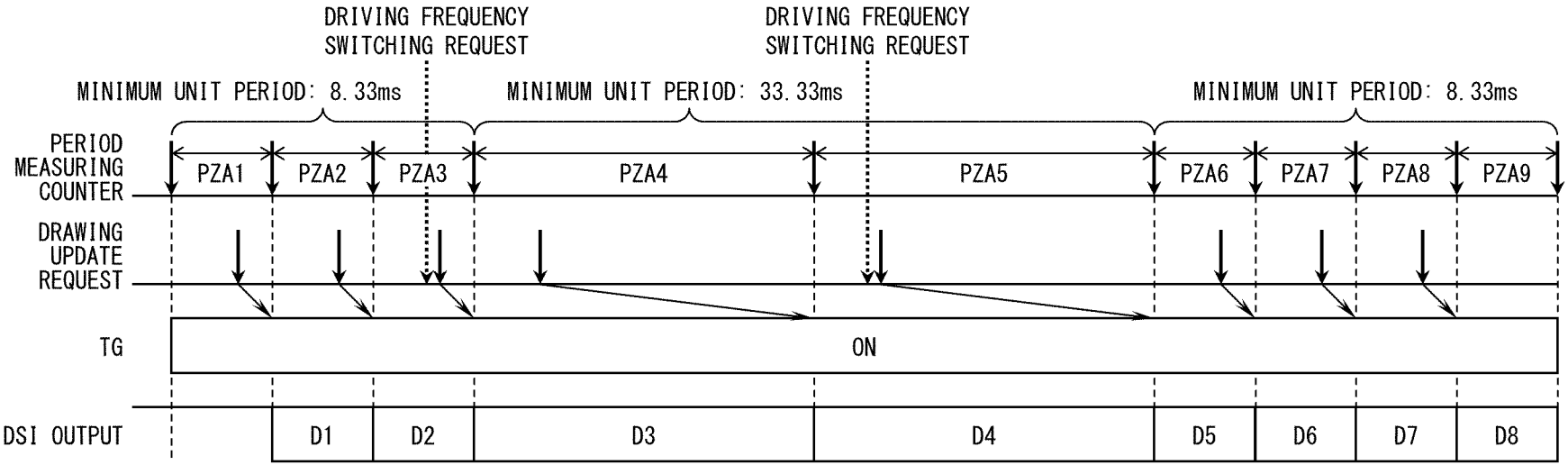
FIG. 4 is a view showing a timing diagram of update of drawing on a display device in accordance with Comparative Example 2.

FIG. 4 is a view showing a timing diagram of update of drawing on a display device in accordance with Comparative Example 2. FIG. 4 illustrates a state in which the display device in accordance with Comparative Example 2 updates drawing with use of a technique called dynamic frames per second (FPS). The display device in accordance with Comparative Example 2 differs from the display device 100 in operations of the TG and the host control section. The other configurations of the display device of Comparative Example 2 are similar to those of the display device 100. In the display device in accordance with Comparative Example 2 illustrated in FIG. 4, it is assumed that the display control section drives the display panel at a driving frequency of up to 120 Hz.

The display control section in accordance with Comparative Example 2 switches an operation mode of the display panel between a first operation mode and a second operation mode every time the display control section has received a driving frequency switching request from the host control section. The first operation mode is a mode in which the display panel is driven so that the minimum unit period becomes 8.33 ms (120 Hz driving). For example, the first operation mode is an operation mode to display a video in which images change for respective frames. The second operation mode is a mode in which the display panel is driven so that the minimum unit period becomes 33.33 ms (30 Hz driving). The second operation mode is an operation mode to display a video in which an image does not change for frames or to display a still image.

In other words, the first operation mode is a mode to drive the display panel at a constant driving frequency of 120 Hz, and the second operation mode is a mode to drive the display panel at a constant driving frequency of 30 Hz.

In the second operation mode, a minimum unit period which is different from that of the first operation mode is obtained by sending a lot of blank data. According to this configuration, clocks for data output are constantly generated in the TG regardless of whether or not drawing is updated, and therefore power consumption of the display device in accordance with Comparative Example 2 is larger than that of the display device 100 in accordance with Embodiment 1.

Consecutive minimum unit periods in which the display control section in accordance with Comparative Example 2 drives the display panel are, in order, a period PZA1, a period PZA2, . . . , a period PZA9, and so forth. Note that the TG included in the display control section in accordance with Comparative Example 2 outputs at least the blank data even in a case where an image for updating drawing is not outputted. Therefore, the TG is in the ON state throughout the period PZA1, the period PZA2, . . . , the period PZA9, and so forth. In the example shown in FIG. 4, each of the periods PZA1 through PZA3 and PZA6 through PZA9 is 8.33 m, and each of the periods PZA4 and PZA5 is 33.33 ms.

The TG included in the display control section in accordance with Comparative Example 2 receives the drawing update requests from the host control section during the respective periods PZA1 and PZA2, and accordingly the display panel updates the image on the display screen to the images D1 and D2 during the respective following periods PZA2 and PZA3.

Then, during the period PZA3 following the period PZA2, the TG receives a driving frequency switching request as well as a drawing update request (e.g., for displaying a still image) from the host control section. Therefore, after the elapse of the period PZA3, the TG sets a period PZA4 in which the minimum unit period is switched from 8.33 ms to 33.33 ms.

The TG then reads image data from the memory and generates a timing signal during the period PZA4. Then, the TG outputs the image data which has been read and the timing signal to the display panel. From this, the display panel receives the timing signal and the image data, and the display panel updates the image on the display screen to an image D3. Thus, the display panel completes the drawing of the image on the display screen.

Then, the TG receives only a drawing update request without receiving a driving frequency switching request from the host control section during the period PZA4. Therefore, after the elapse of the period PZA4, the TG sets a period PZA5 of 33.33 ms in which the 30 Hz driving is carried out as with the period PZA4. The display panel then updates the image on the display screen to an image D4 during the period PZA5. Thus, the display panel completes the drawing of the image on the display screen.

Then, during the period PZA5, the TG receives a driving frequency switching request as well as a drawing update request from the host control section. Therefore, after the elapse of the period PZA5, the TG sets a period PZA6 in which the minimum unit period is switched from 33.33 ms to 8.33 ms. The display panel then updates the image on the display screen to an image D5 during the period PZA6. Thus, the display panel completes the drawing of the image on the display screen.

Subsequently, the TG similarly checks, for each minimum unit period, whether or not the TG has received a drawing update request and a driving frequency switching request from the host control section. In a case where the TG has received a drawing update request from the host control section during the minimum unit period, the display panel updates drawing of the image during a next minimum unit period of the minimum unit period during which the TG has received the drawing update request. In a case where the TG has received a driving frequency switching request from the host control section during the minimum unit period, the TG changes a length of a next minimum unit period of the minimum unit period during which the TG has received the driving frequency switching request.

In the example shown in FIG. 4, the TG receives the drawing update requests during the periods PZA1 through PZA8, respectively, and the display panel updates the drawn image to images D1 through D8 in the respective periods PZA2 through PZA9 which are respectively subsequent to the periods PZA1 through PZA8.

According to the display device in accordance with Comparative Example 2, the TG switches a length of a minimum unit period which follows a minimum unit period during which a driving frequency switching request is received. Specifically, the TG which has received a driving frequency switching request during the period PZA3 sets, after the period PZA3, the period PZA4 in which the length of the minimum unit period is switched from 8.33 ms to 33.33 ms. Moreover, the TG which has received a driving frequency switching request during the period PZA5 sets, after the period PZA5, the period PZA6 in which the length of the minimum unit period is switched from 33.33 ms to 8.33 ms.

Thus, according to the display device in accordance with Comparative Example 2, a time lag from when the drawing update request has been sent from the host control section to the TG to when the update of drawing is carried out is up to 33.33 ms. Alternatively, for example, in a case where the second operation mode is driven at 1 Hz, a time lag from when the drawing update request has been sent from the host control section to the TG to when the update of drawing is carried out is up to 1 s. As such, according to the display device in accordance with Comparative Example 2, a response until the image displayed on the display screen is updated is slow.

(Update of Drawing of Display Device 100)

Figure 5:
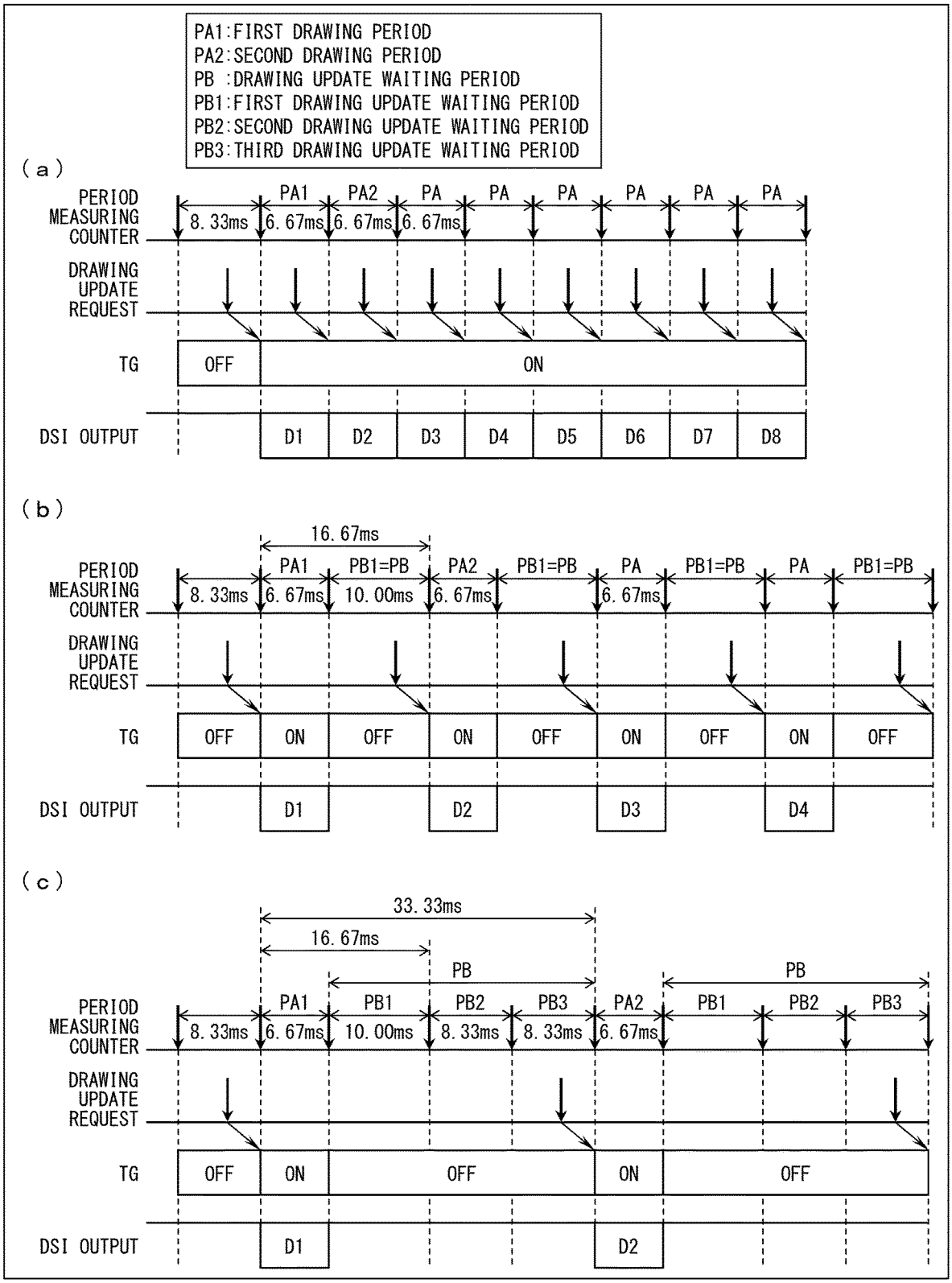
FIG. 5 is a view showing a timing diagram of update of drawing on a display device in accordance with Embodiment 1.

FIG. 5 is a view showing a timing diagram of update of drawing on the display device 100 in accordance with Embodiment 1. (a) of FIG. 5 is a view showing a timing diagram of update of drawing in the display device 100 in a case where a drawing update request is made during a drawing period. (b) of FIG. 5 is a view showing a timing diagram of update of drawing in the display device 100 in a case where a drawing update request is made for each period of 60 fps. (c) of FIG. 5 is a view showing a timing diagram of update of drawing in the display device 100 in a case where a drawing update request is made for each period of 30 fps.

As shown in (a) through (c) of FIG. 5, as an example, it is assumed that the display control section 3 drives the display panel 2 at a driving frequency of 120 Hz immediately before a drawing update request is inputted. In this case, the minimum unit period of the driving period of the display panel 2 is 8.33 ms. This minimum unit period is measured by counting inputted clocks by the period measuring counter 21. The period measuring counter 21 counts the inputted clocks and notifies, every 8.33 ms, the drawing control section 23 of the fact that the set minimum unit period has elapsed. The drawing control section 23 checks, every 8.33 ms (which is the minimum unit period measured by the period measuring counter 21), whether or not the TG 20 has received a drawing update request from the host control section 1.

In a case where the TG 20 has not received a drawing update request from the host control section 1 during the minimum unit period of 8.33 ms, the drawing control section 23 checks again whether or not the TG 20 has received a drawing update request from the host control section 1 after the minimum unit period of 8.33 ms has elapsed.

In a case where the TG 20 has received a drawing update request from the host control section 1 during the minimum unit period of 8.33 ms, the drawing control section 23 recognizes that the TG 20 has received the drawing update request after the elapse of the minimum unit period during which the drawing update request has been received. Then, after the elapse of 8.33 ms which is the minimum unit period during which the TG 20 has received the drawing update request, the drawing control section 23 successively sets a drawing period PA for drawing an image, and starts an operation to update drawing of the image.

That is, after the elapse of 8.33 ms which is the minimum unit period during which the TG 20 has received the drawing update request, the TG 20 enters the ON state and outputs a timing signal and image data to the display panel 2. That is, the TG 20 carries out DSI output to the display panel 2. From this, upon receipt of the timing signal and the image data, the display panel 2 updates the image on the display screen. Thus, the display panel 2 completes the drawing of the image on the display screen.

The drawing period PA is a period from when the TG 20 has entered the ON state to when the update of drawing of the image on the display screen of display panel 2 is completed. For example, in a case where the image data inputted to the display device 100 is video data of 150 Hz, the drawing period PA is 6.67 ms. The drawing period PA is not a period measured by the period measuring counter 21, but is a period that is taken to complete drawing of one (1) image on the display panel 2. In other words, the drawing period PA is a time minimally needed to update the drawing.

With reference to (a) of FIG. 5, a case where the display device 100 is driven at 150 Hz will be described as Comparative Example 3. (a) of FIG. 5 shows an example in which the TG 20 receives a drawing update request from the host control section 1 during a drawing period PA, and therefore drawing periods PA are successively set. That is, the drawing control section 23 sets a first drawing period PA1 (drawing period PA) that follows the minimum unit period of 8.33 ms and corresponds to inputted image data, and thus the display panel 2 updates the image on the display screen to an image D1 during the first drawing period PA1.

Then, the drawing control section 23 which has also received a drawing update request during the first drawing period PA1 (drawing period PA) recognizes, after the elapse of the first drawing period PA1 during which the TG 20 has received the drawing update request, that the TG 20 has received the drawing update request. The drawing control section 23 then sets a second drawing period PA2 (drawing period PA) which follows the first drawing period PA1 and has a length identical with that of the first drawing period PA1. The display panel 2 then updates the image on the display screen to an image D2 during the second drawing period PA2.

Note that, in the second drawing period PA2, an image is drawn which is identical with an image drawn in the first drawing period PA1 or an image is drawn which is for a frame following the image drawn in the first drawing period PA1. This allows the display panel 2 to be refreshed in the second drawing period PA2 that follows the first drawing period PAL Subsequently, similarly, in a case where the drawing control section 23 has received a drawing update request during the second drawing period PA2 (drawing period PA), the drawing control section 23 sets a drawing period PA which follows the second drawing period PA2 and has a length identical with that of the second drawing period PA2, and the display panel 2 updates the image on the display screen to an image D3 during the drawing period PA. Thus, the drawing periods PA are successively set, and the display panel 2 sequentially updates the image on the display screen to the images D4, D5, D6, and so forth for the respective drawing periods PA. In this Comparative Example 3, the display panel 2 carries out update of drawing in the minimum unit period of 6.67 ms during the period in which the drawing period PA is set, and therefore a driving frequency becomes 150 Hz.

As such, according to the drawing control section 23, update of drawing can be carried out quickly after receipt of the drawing update request from the host control section 1, as compared with Comparative Example 1 in which the minimum unit period is constantly 8.33 ms.

Here, even in a case of the display device 100 that can carry out 150 Hz driving, if the minimum unit period is simply set to a period (here, 6.67 ms) identical with the drawing period PA which is the fastest updatable period after the drawing update request is made by the host control section 1 in 150 Hz driving, such a minimum unit period may not match a frame period of content that is drawn by an application or the like executed on the display device 100. For example, pieces of content at frame frequencies such as 30 fps and 60 fps are generally spread but a multiple of 6.67 ms does not match 16.67 ms. Therefore, as shown in (b) and (c) of FIG. 5, the drawing control section 23 sets a drawing update waiting period PB which follows the drawing period PA.

In the example shown in (b) of FIG. 5, the display panel 2 updates drawing for each period of 60 fps. That is, in a case where the TG 20 has received a drawing update request from the host control section 1 during the minimum unit period of 8.33 ms which is the minimum unit period in driving the display panel 2 at a driving frequency of 120 Hz, the drawing control section 23 recognizes that the TG 20 has received the drawing update request after the elapse of the minimum unit period during which the TG 20 has received the drawing update request. Then, after the elapse of the minimum unit period of 8.33 ms during which the TG 20 has received the drawing update request, the drawing control section 23 successively sets a first drawing period PA1. The display panel 2 thus updates the image on the display screen to an image D1 during the first drawing period PA1.

Then, in a case where the drawing control section 23 has not received a drawing update request during the first drawing period PA1, the drawing control section 23 recognizes, after the elapse of the first drawing period PA1, that the TG 20 has not received the drawing update request. The drawing control section 23 then sets a drawing update waiting period PB which follows the first drawing period PA1 and is a period for waiting for update of drawing of the image.

Here, the drawing control section 23 sets the drawing update waiting period PB such that the drawing update waiting period PB becomes different in length from the first drawing period PA1 and a combined period of the drawing update waiting period PB and the first drawing period PA1 matches a frame interval (here, 1/60 s which is a reciprocal number of 60 fps) of content that is reproduced by the display device 100.

For example, the drawing control section 23 sets the drawing update waiting period PB to 10.00 ms. From this, a combined period of 6.67 ms (i.e., the first drawing period PA1) and 10 ms (i.e., the drawing update waiting period PB) becomes 16.67 ms (that is, 1/60 s).

This drawing update waiting period PB is measured by counting inputted clocks by the period measuring counter 21. The period measuring counter 21 counts the inputted clocks and notifies the drawing control section 23 of the fact that the set 10.00 ms has elapsed. Note that, although the drawing update waiting period PB may be further divided into a plurality of periods, here, the drawing update waiting period PB of 10.00 ms is the minimum unit period in the drawing update waiting period PB.

After the drawing update waiting period PB has elapsed, the drawing control section 23 checks whether or not the drawing control section 23 has received a drawing update request from the host control section 1 during the drawing update waiting period PB. Then, in a case where the TG 20 has received a drawing update request from the host control section 1 during the drawing update waiting period PB, the drawing control section 23 successively sets a second drawing period PA2 which has a length identical with the first drawing period PA after the minimum unit period of 10.00 ms has elapsed, during which the drawing control section 23 has received the drawing update request. The display panel 2 thus updates the image on the display screen to an image D2 during the second drawing period PA2.

Subsequently, similarly, the drawing control section 23 sets a drawing update waiting period PB that follows the second drawing period PA2, unless the TG 20 has received a drawing update request from the host control section 1 during the second drawing period PA2. In a case where the TG 20 has received a drawing update request from the host control section 1 during the drawing update waiting period PB, the drawing control section 23 sets a drawing period PA that follows the drawing update waiting period PB, and the display panel 2 updates the image on the display screen to an image D3 during the drawing period PA. Thus, the display panel 2 sequentially updates the image on the display screen to the images D4, D5, D6, and so forth for the respective drawing periods PA.

As above described, in a case where the TG 20 receives a drawing update request from the host control section 1 for each period of 60 fps, the drawing control section 23 sets a drawing update waiting period PB following the first drawing period PA1 such that a length of the drawing update waiting period PB differs from the first drawing period PA1 and a combined period of the drawing update waiting period PB and the first drawing period PA1 matches a frame interval (i.e., 1/60 s) of content. Therefore, the display panel 2 can carry out update of drawing during the period that matches 60 fps, which is the interval for sending a drawing update request from the host control section 1.

In the example shown in (c) of FIG. 5, the display panel 2 updates drawing for each period of 30 fps. That is, in a case where the TG 20 has received a drawing update request from the host control section 1 during the minimum unit period of 8.33 ms which is the minimum unit period in driving the display panel 2 at a driving frequency of 120 Hz, the drawing control section 23 recognizes that the TG 20 has received the drawing update request after the elapse of the minimum unit period during which the TG 20 has received the drawing update request. Then, after the elapse of the minimum unit period of 8.33 ms during which the TG 20 has received the drawing update request, the drawing control section 23 successively sets a first drawing period PA1. The display panel 2 thus updates the image on the display screen to an image D1 during the first drawing period PA1.

Then, in a case where the drawing control section 23 has not received a drawing update request during the first drawing period PA1, the drawing control section 23 recognizes, after the elapse of the first drawing period PA1, that the drawing control section 23 has not received the drawing update request during the first drawing period PA1. The drawing control section 23 then sets a drawing update waiting period PB which follows the first drawing period PA1 and is a period for waiting for update of drawing of the image.

Here, the drawing control section 23 sets the drawing update waiting period PB such that the drawing update waiting period PB becomes different in length from the first drawing period PA1 and a combined period of the drawing update waiting period PB and the first drawing period PA1 matches a frame interval (here, 1/30 s which is a reciprocal number of 30 fps) of content that is reproduced by the display device 100. For example, the drawing control section 23 sets the drawing update waiting period PB to 26.66 ms. From this, a combined period of 6.67 ms (i.e., the first drawing period PA1) and 26.66 ms (i.e., the drawing update waiting period PB) becomes 33.33 ms (that is, 1/30 s).

In the example shown in (c) of FIG. 5, the drawing control section 23 further divides the drawing update waiting period PB into a plurality of successive periods. For example, as the drawing update waiting period PB, the drawing control section 23 sets a first drawing update waiting period PB1, a second drawing update waiting period PB2, and a third drawing update waiting period PB3, which are consecutive periods.

The first drawing update waiting period PB1 can be set to, for example, 10.00 ms, so that a combined period of the first drawing period PA1 and the first drawing update waiting period PB1 becomes 16.67 ms (1/60 s), which is a half of 33.33 ms (i.e., 1/30 s).

Each of the second drawing update waiting period PB2 and the third drawing update waiting period PB3 can be set to 8.33 ms, so that a combined period of the second drawing update waiting period PB2 and the third drawing update waiting period PB3 becomes 16.67 ms (1/60 s), which is the other half of 33.33 ms (i.e., 1/30 s).

In this manner, the drawing update waiting period PB can be constituted by combining a plurality of periods. Here, each of the first drawing update waiting period PB1, the second drawing update waiting period PB2, and the third drawing update waiting period PB3 is the minimum unit period in the drawing update waiting period PB.

Each of the first drawing update waiting period PB1, the second drawing update waiting period PB2, and the third drawing update waiting period PB3 is measured by counting inputted clocks by the period measuring counter 21. The period measuring counter 21 counts the inputted clocks and, each time each of the set periods, i.e., the first drawing update waiting period PB1, the second drawing update waiting period PB2, and the third drawing update waiting period PB3 has elapsed, the period measuring counter 21 notifies the drawing control section 23 of the fact that each of the set periods has elapsed.

Each time each of the first drawing update waiting period PB1, the second drawing update waiting period PB2, and the third drawing update waiting period PB3 has elapsed, the drawing control section 23 checks whether the TG 20 has received a drawing update request from the host control section 1 during each of those periods. For example, in a case where the TG 20 has received a drawing update request from the host control section 1 during the third drawing update waiting period PB3, the drawing control section 23 successively sets a second drawing period PA2 which has a length identical with the first drawing period PA after the elapse of the third drawing update waiting period PB3. Alternatively, in a case where the drawing control section 23 has received a drawing update request from the host control section 1 during the second drawing update waiting period PB2, the drawing control section 23 can successively set a second drawing period PA2 which has a length identical with the first drawing period PA after the elapse of the second drawing update waiting period PB2, without setting the third drawing update waiting period PB3. The display panel 2 thus updates the image on the display screen to an image D2 during the second drawing period PA2.

Subsequently, similarly, the drawing control section 23 sets a drawing update waiting period PB that follows the second drawing period PA2, unless the TG 20 has received a drawing update request from the host control section 1 during the second drawing period PA2. In a case where the TG 20 has received a drawing update request from the host control section 1 during the drawing update waiting period PB, the drawing control section 23 sets a drawing period PA that follows the drawing update waiting period PB, and the display panel 2 updates the image on the display screen during the drawing period PA. Thus, the display panel 2 sequentially updates the images on the display screen for the respective drawing periods PA.

As above described, in a case where the TG 20 receives a drawing update request from the host control section 1 for each period of 30 fps, the drawing control section 23 sets a drawing update waiting period PB following the first drawing period PA1 such that a length of the drawing update waiting period PB differs from the first drawing period PA1 and a combined period of the drawing update waiting period PB and the first drawing period PA1 matches a frame interval (i.e., 1/30 s) of content. Therefore, the display panel 2 can carry out update of drawing during the period that matches 30 fps, which is the interval for sending a drawing update request from the host control section 1.

Therefore, according to the display control section 3, it is possible to prevent a non-displayed image (called a dropped frame) which is caused by a disagreement between the frame frequency of the content to be reproduced and the driving frequency of the display panel 2, as compared with the case where, for example, the driving frequency is constantly at 120 Hz as in Comparative Example 1. Consequently, it is possible to prevent a deterioration in display quality.

There may be a case where it was expected to receive a drawing update request from the host control section 1 for each period of 30 fps or 60 fps but, for some reason, the drawing update request from the host control section 1 is received for each period shorter than the originally expected 30 fps or 60 fps. Even in such a case, the drawing control section 23 checks, after the elapse of the drawing period PA and after the elapse of the drawing update waiting period PB each of which is a period shorter than the original 30 fps or 60 fps, whether or not a drawing update request has been made by the host control section 1. Therefore, the drawing control section 23 can cause the display panel 2 to update the drawing for each period shorter than the original 30 fps or 60 fps.

From this, unlike the case where the driving frequency is switched for each operation mode as in Comparative Example 2, the drawing control section 23 allows the display panel 2 to carry out update of drawing by a quick response after receipt of a drawing update request from the host control section 1.

That is, the display panel 2 including the drawing control section 23 can (i) prevent a deterioration in display quality caused by a disagreement between a frame interval of content and an interval for updating drawing, and (ii) carry out update of drawing quickly after receipt of a drawing update request.

In the example shown in (c) of FIG. 5, the drawing update waiting period PB is constituted by a plurality of minimum unit periods, i.e., the first drawing update waiting period PB1, the second drawing update waiting period PB2, and the third drawing update waiting period PB3. Each time each of the first drawing update waiting period PB1, the second drawing update waiting period PB2, and the third drawing update waiting period PB3 has elapsed, the drawing control section 23 checks whether the host control section 1 has made a drawing update request during each of those periods.

According to the configuration, even in a case where it was expected to receive a drawing update request from the host control section 1 for each period of 30 fps but for some reason the TG 20 has received a drawing update request from the host control section 1 for each period shorter than 30 fps, the drawing control section 23 can check, after each of the first drawing update waiting period PB1, the second drawing update waiting period PB2, and the third drawing update waiting period PB3 has elapsed, whether or not a drawing update request has been made. The display panel 2 can then carry out update of drawing. From this, the drawing control section 23 can cause the display panel 2 to update the drawing more quickly after receiving the drawing update request from the host control section 1, as compared with a case where the drawing update waiting period PB is not divided into a plurality of periods.

Although it has been described that the drawing update waiting period PB is divided into the three periods, i.e., the first drawing update waiting period PB1, the second drawing update waiting period PB2, and the third drawing update waiting period PB3, the number of divisions of the drawing update waiting period PB is not limited to three, and may be two or four or more.

By thus constituting the drawing update waiting period PB by the combination of the plurality of periods, various periods can be combined so as to match with the frame interval of content. Therefore, it is possible to increase variations of periods to be combined. In particular, in the example shown in (c) of FIG. 5, a combined period of the first drawing period PA1 and the first drawing update waiting period PB1 is made identical with a combined period of the second drawing update waiting period PB2 and the third drawing update waiting period PB3.

In other words, the drawing control section 23 sets the first drawing update waiting period PB1 for the first drawing period PA1 such that the combined period of the first drawing period PA1 and the first drawing update waiting period PB1 becomes twice the length (e.g., 16.67 ms) of the period (e.g., 8.33 ms), which is commonly used as a driving period of a display panel. Thus, each of the second drawing update waiting period PB2 and the third drawing update waiting period PB3 can be set to a period (e.g., 8.33 ms) that has actually been commonly used as a driving period of a display panel. As a result, the display control section 3 can drive the display panel 2 while inhibiting generation of a malfunction.

In the example shown in (c) of FIG. 5, a reciprocal number of a combined period of the first drawing period PA1 and the first drawing update waiting period PB1 is 60 Hz. By setting the first drawing update waiting period PB1 in this manner, the drawing control section 23 can set the reciprocal number of the combined period of the first drawing period PA1 and the first drawing update waiting period PB1 to be a frequency (60 Hz), which has actually been commonly used as a driving frequency of a display panel. As a result, the display control section 3 can drive the display panel 2 while inhibiting generation of a malfunction.

In the example shown in (c) of FIG. 5, a reciprocal number of a combined period of the first drawing period PA1, the first drawing update waiting period PB1, the second drawing update waiting period PB2, and the third drawing update waiting period PB3 is 30 Hz. From this, the reciprocal number can be set to be a frequency (30 Hz), which has actually been commonly used as a driving frequency of a display panel. As a result, the display control section 3 can drive the display panel 2 while inhibiting generation of a malfunction.

(Flowchart of Update of Drawing on Display Device)

Figure 6:
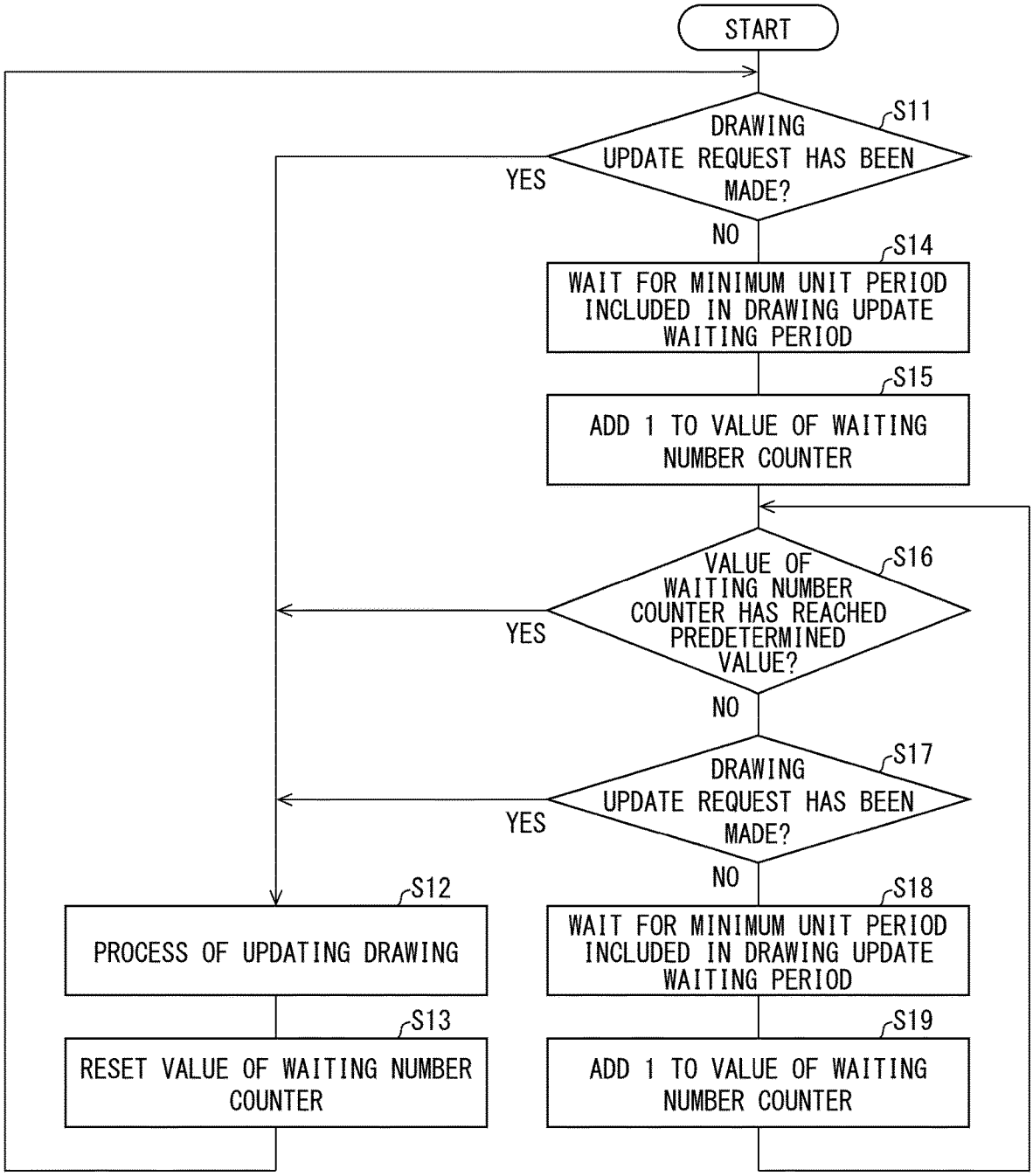
FIG. 6 is a view showing a flowchart of update of drawing on the display device in accordance with Embodiment 1.

FIG. 6 is a view showing a flowchart of update of drawing on the display device in accordance with Embodiment 1. As shown in FIG. 6, after the minimum unit period has elapsed, the drawing control section 23 determines whether or not a drawing update request has been made by the host control section 1 during the minimum unit period (step S11).

In a case where the drawing control section 23 has determined in the step S11 that a drawing update request has been made during the minimum unit period (Yes in step S11), the drawing control section 23 carries out a process of updating drawing in the following minimum unit period after the elapse of the minimum unit period during which the drawing update request has been made (step S12). For example, in the example shown in (c) of FIG. 5, the process of updating drawing takes 6.67 ms (e.g., a first drawing period PA1). The drawing control section 23 then resets the value of the waiting number counter 22 (step S13). Then, the process returns to the step S11.

In a case where the drawing control section 23 has determined in the step S11 that no drawing update request has been made during the minimum unit period (No in step S11), the drawing control section 23 sets, after the elapse of the minimum unit period during which no drawing update request has been made, a minimum unit period that constitutes a drawing update waiting period PB which is a period for waiting for update of drawing (step S14). For example, in the example shown in (c) of FIG. 5, the minimum unit period is the first drawing update waiting period PB1 (10.00 ms).

Note that, as shown in (b) of FIG. 5, in a case where the drawing update waiting period PB is not divided into a plurality of minimum unit periods, the minimum unit period constituting the drawing update waiting period PB is the drawing update waiting period PB.

Next, the drawing control section 23 adds 1 to the value of the waiting number counter 22 (step S15). The drawing control section 23 then determines whether or not the value of the waiting number counter 22 has reached a predetermined value (step S16).

In the step S16, in a case where the drawing control section 23 has determined that the value of the waiting number counter 22 has reached the predetermined value (Yes in step S16), the drawing control section 23 carries out the process of the step S12. That is, the drawing control section 23 causes the display panel 2 to carry out update of drawing. This prevents the display panel 2 from being driven at a frequency below an expected lowest driving frequency. That is, the image on the display panel 2 is updated at a minimally needed refresh rate (e.g., 1 Hz). This prevents a deterioration in display quality of the image on the display panel 2. Then, the process of the step S13 is carried out.

In a case where the drawing control section 23 has determined in the step S16 that the value of the waiting number counter 22 has not reached the predetermined value (No in step S16), the drawing control section 23 determines whether or not a drawing update request has been made by the host control section 1 during the minimum unit period (step S17).

In the step S17, in a case where the drawing control section 23 has determined that a drawing update request has been made during the minimum unit period (Yes in step S17), the drawing control section 23 carries out the process in the step S12. In a case where the drawing control section 23 has determined in the step S17 that no drawing update request has been made during the minimum unit period (No in step S17), the drawing control section 23 sets, after the elapse of the minimum unit period during which no drawing update request has been made, a minimum unit period that constitutes a drawing update waiting period PB which is a period for waiting for update of drawing (step S18). For example, in the example shown in (c) of FIG. 5, the minimum unit period is the second drawing update waiting period PB2 (8.33 ms). Note that, as shown in (b) of FIG. 5, in a case where the drawing update waiting period PB is not divided into a plurality of minimum unit periods, the minimum unit period constituting the drawing update waiting period PB is the drawing update waiting period PB. Next, the drawing control section 23 adds 1 to the value of the waiting number counter 22 (step S19). Then, the process returns to the step S16.

Thus, as shown in (b) and (c) of FIG. 5 and FIG. 6, in a case where the drawing control section 23 has received no drawing update request from the host control section 1 during the first drawing period PA1 in the step S11 (No in step S11), the drawing control section 23 sets a drawing update waiting period PB which follows the first drawing period PA1 (step S14). Moreover, as shown in (a) of FIG. 5 and FIG. 6, in a case where the drawing control section 23 has received a drawing update request during the first drawing period PA1 in the step S11 (Yes in step S11), the drawing control section 23 sets a second drawing period PA2 which follows the first drawing period PA1 and has a length identical with the first drawing period PA1.

Thus, in a case where the drawing control section 23 has received no drawing update request during the first drawing period PA1, the drawing control section 23 sets the drawing update waiting period PB so that the drawing update waiting period PB matches the frame interval of the content. From this, it is possible to prevent a disagreement between the frame interval of the content and the interval for updating the drawing. In a case where the TG 20 has received a drawing update request during the first drawing period PA1, the drawing control section 23 sets a second drawing period PA2 following the first drawing period PA1, and this makes it possible to carry out update of drawing quickly after receipt of the drawing update request.

From this, it is possible to prevent a disagreement between the frame interval of the content and the driving interval of the display panel 2. Further, in a case where a drawing update request has been received during a period equal to or shorter than the drawing period PA, the display panel 2 can update the drawing during the drawing period PA, which is a shortest period during which drawing can be updated.

Moreover, as shown in (b) and (c) of FIG. 5 and FIG. 6, in a case where the drawing control section 23 has received a drawing update request during the drawing update waiting period PB (Yes in step S17), the drawing control section 23 sets a second drawing period PA2 which follows the drawing update waiting period PB and has a length identical with the first drawing period PA1 (step S12).

From this, in a case where the TG 20 has received a drawing update request during the drawing update waiting period PB, the drawing control section 23 sets the second drawing period following the drawing update waiting period PB, and this makes it possible to carry out update of drawing quickly after receipt of the drawing update request.

Embodiment 2

Figure 7:
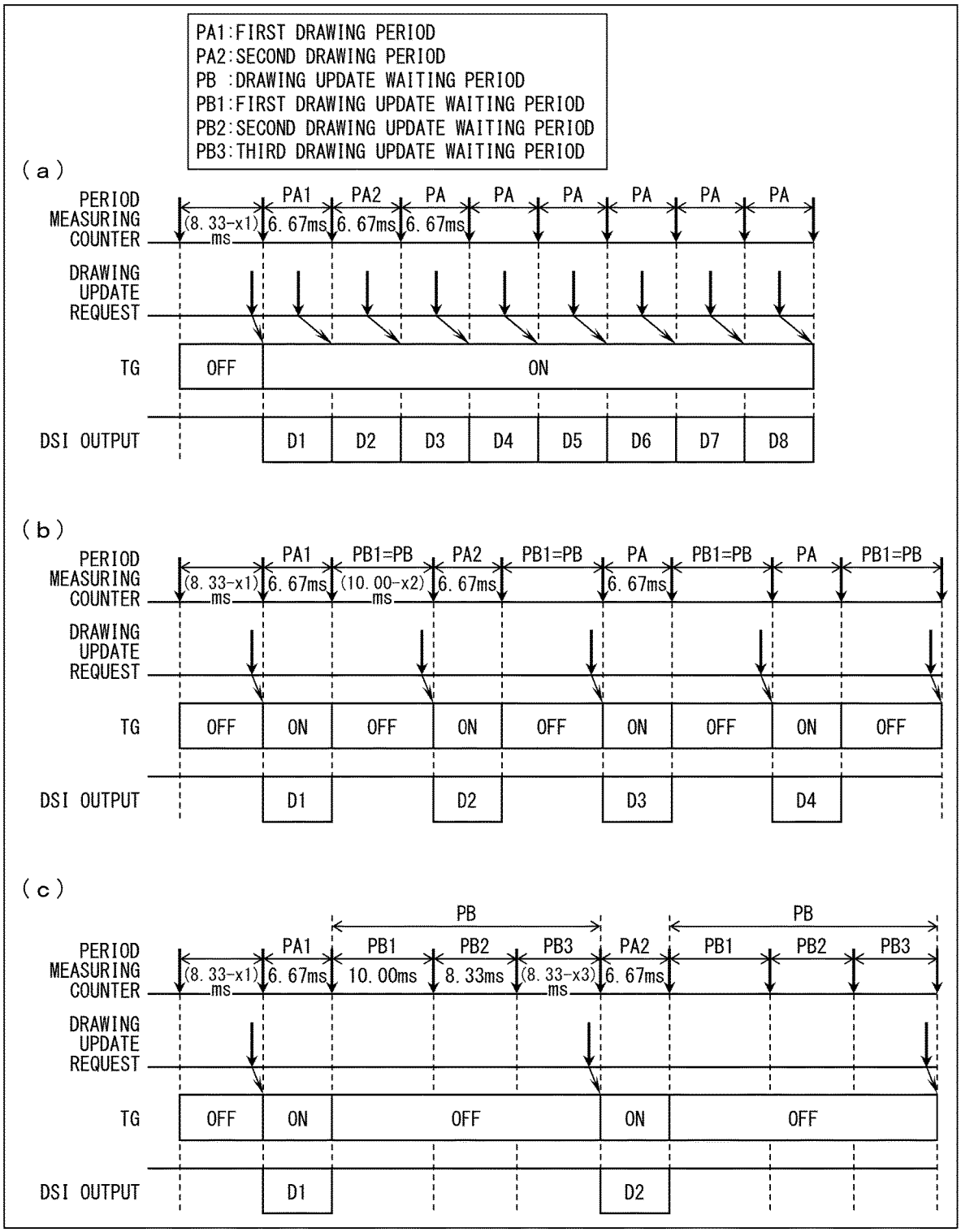
FIG. 7 is a view showing a timing diagram of update of drawing on a display device in accordance with Embodiment 2.

FIG. 7 is a view showing a timing diagram of update of drawing on a display device 100 in accordance with Embodiment 2. (a) of FIG. 7 is a view showing a timing diagram of update of drawing in the display device 100 in a case where a drawing update request is made during a drawing period. (b) of FIG. 7 is a view showing a timing diagram of update of drawing in the display device 100 in a case where a drawing update request is made for each period of 60 fps. (c) of FIG. 7 is a view showing a timing diagram of update of drawing in the display device 100 in a case where a drawing update request is made for each period of 30 fps.

In order to further improve a response, the drawing control section 23 may be triggered by some sort of input (such as a drawing update request or a touch event) to stop the period measuring counter 21 and cause the display panel 2 to immediately update drawing.

In the example shown in (a) of FIG. 7, it is assumed that the display control section 3 drives the display panel 2 at a driving frequency of 120 Hz immediately before a drawing update request is inputted. In this case, the minimum unit period of the driving period of the display panel 2 is 8.33 ms.

In a case where the TG 20 has received a drawing update request from the host control section 1 during the set minimum unit period of 8.33 ms, the drawing control section 23 causes the period measuring counter 21 to stop counting. Then, the drawing control section 23 (i) sets, before the minimum unit period during which the drawing update request has been received elapses (i.e., at (8.33−x1) ms), a first drawing period PA1 which follows the minimum unit period and during which an image is drawn, and (ii) starts an operation to update drawing of the image.

In other words, in a case where the TG 20 has received a drawing update request, the drawing control section 23 changes the minimum unit period to (8.33−x1) ms from 8.33 ms, which is the minimum unit period set until the drawing update request is received.

Then, immediately after receipt of the drawing update request, the TG 20 enters an ON state and outputs a timing signal and image data to the display panel 2. That is, the TG 20 carries out DSI output to the display panel 2. From this, upon receipt of the timing signal and the image data, the display panel 2 updates the image on the display screen. Thus, the display panel 2 completes the drawing of the image on the display screen. Subsequently, as with the case shown in (a) of FIG. 5, the drawing periods PA are successively set, and the display panel 2 sequentially updates the images on the display screen for the respective drawing periods PA.

In the example shown in (b) of FIG. 7, the display panel 2 has set a waiting period for drawing under a schedule to carry out update of drawing for each period of 60 fps. In a case where the TG 20 has received a drawing update request from the host control section 1 during the set minimum unit period of 8.33 ms, the drawing control section 23 causes the period measuring counter 21 to stop counting. Then, the drawing control section 23 (*i*) sets, before the minimum unit period during which the drawing update request has been received elapses (i.e., at (8.33−x1) ms), a first drawing period PA1 (6.67 ms) which follows the minimum unit period and during which an image is drawn, and (ii) updates the image on the display screen to an image D1.

Next, in a case where the drawing control section 23 has not received a drawing update request during the first drawing period PA1, the drawing control section 23 sets a drawing update waiting period PB (10.00 ms) which follows the first drawing period PA1 and is a period for waiting for update of drawing of the image.

In a case where the TG 20 has received a drawing update request from the host control section 1 during the set minimum unit period of 10.00 ms, the drawing control section 23 causes the period measuring counter 21 to stop counting. Then, the drawing control section 23 (*i*) sets, before the minimum unit period during which the drawing update request has been received elapses (i.e., at (10.00−x2) ms), a second drawing period PA2 (6.67 ms) which follows the minimum unit period and during which an image is drawn, and (ii) updates the image on the display screen to an image D2.

Subsequently, similarly, in a case where the TG 20 has received a drawing update request from the host control section 1 during the drawing update waiting period PB (10.00 ms), the drawing control section 23 (*i*) causes the period measuring counter 21 to stop counting, (ii) sets a drawing period PA (6.67 ms) without waiting for the elapse of the drawing update waiting period PB (10.00 ms), and (iii) updates the image on the display screen.

In the example shown in (c) of FIG. 7, the display panel 2 has set a waiting period for drawing under a schedule to carry out update of drawing for each period of 30 fps. In a case where the TG 20 has received a drawing update request from the host control section 1 during the set minimum unit period of 8.33 ms, the drawing control section 23 causes the period measuring counter 21 to stop counting. Then, the drawing control section 23 (*i*) sets, before the minimum unit period during which the drawing update request has been received elapses (i.e., at (8.33−x1) ms), a first drawing period PA1 (6.67 ms) which follows the minimum unit period and during which an image is drawn, and (ii) updates the image on the display screen to an image D1.

Next, in a case where the drawing control section 23 has not received a drawing update request during the first drawing period PA1, the drawing control section 23 sets a drawing update waiting period PB (26.66 ms) which follows the first drawing period PA1 and is a period for waiting for update of drawing of the image.

In the example shown in (c) of FIG. 7, as the drawing update waiting period PB (26.66 ms), the drawing control section 23 sets a first drawing update waiting period PB1 (10.00 ms), a second drawing update waiting period PB2 (8.33 ms), and a third drawing update waiting period PB3 (8.33 ms), which are consecutive periods.

In a case where the TG 20 has received a drawing update request from the host control section 1 during the third drawing update waiting period PB3 (8.33 ms) which is the set minimum unit period, the drawing control section 23 causes the period measuring counter 21 to stop counting. Then, the drawing control section 23 (*i*) sets, before the minimum unit period during which the drawing update request has been received elapses (i.e., at (8.33−x3) ms), a second drawing period PA2 (6.67 ms) which follows the minimum unit period and during which an image is drawn, and (ii) updates the image on the display screen to an image D2.

Subsequently, similarly, in a case where the TG 20 has received a drawing update request from the host control section 1 during any of the first drawing update waiting period PB1 (10.00 ms), the second drawing update waiting period PB2 (8.33 ms), and the third drawing update waiting period PB3 (8.33 ms), which are the minimum unit periods obtained by dividing the drawing update waiting period PB (26.66 ms), the drawing control section 23 (*i*) causes the period measuring counter 21 to stop counting, (ii) sets a drawing period PA (6.67 ms) without waiting for the elapse of the minimum unit period during which the drawing update request has been received, and (iii) updates the image on the display screen.

Figure 8:
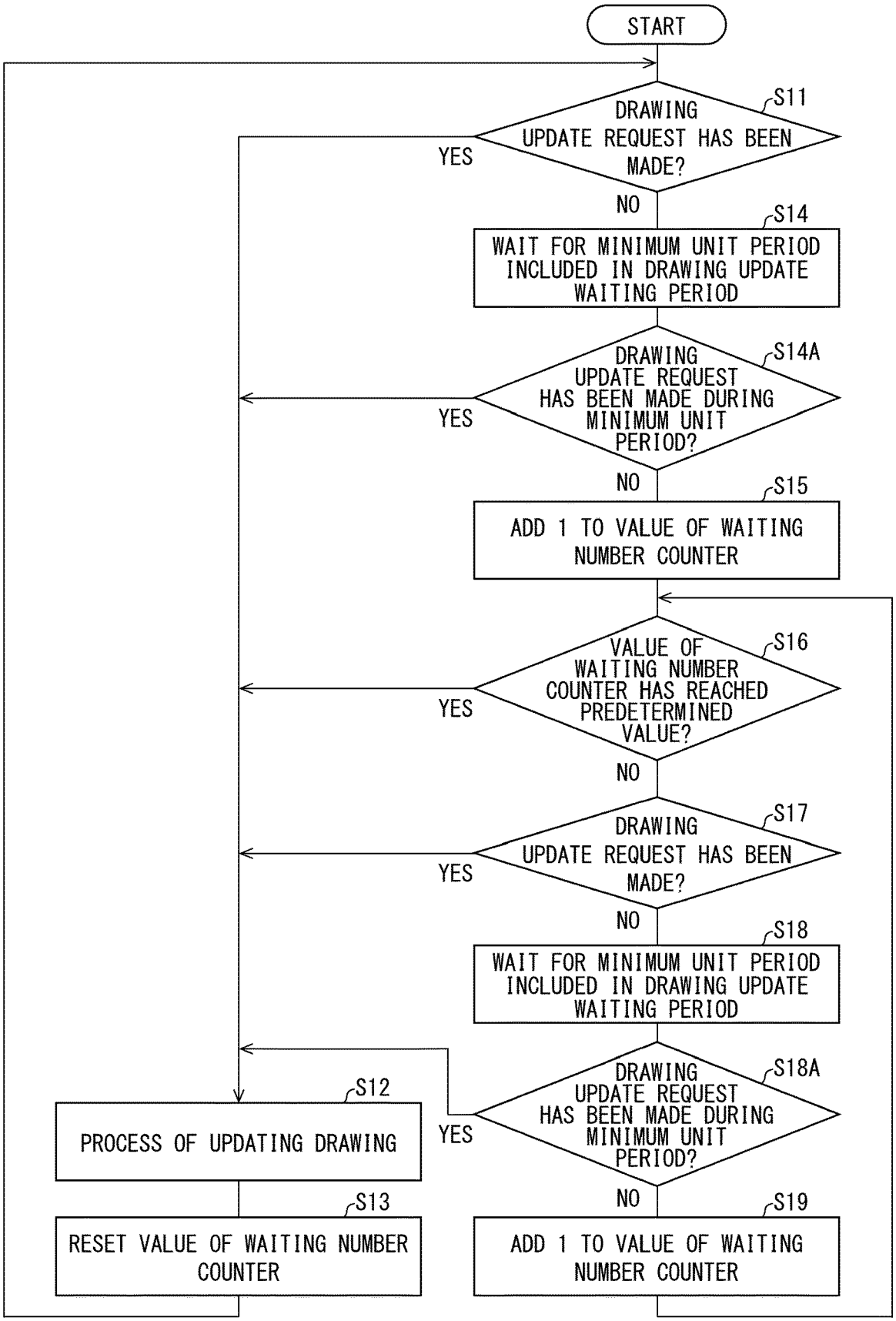
FIG. 8 is a view showing a flowchart of update of drawing on the display device in accordance with Embodiment 2.

FIG. 8 is a view showing a flowchart of update of drawing on the display device in accordance with Embodiment 2. In the flowchart shown in FIG. 8, the processes from Yes in the step S11, the step S12, the step S13, and then to the step S11 again are identical with those described in Embodiment 1 with reference to FIG. 6.

In a case where the drawing control section 23 has determined in the step S11 that no drawing update request has been made during the minimum unit period (No in step S11), the drawing control section 23 sets, after the elapse of the minimum unit period during which no drawing update request has been made, a minimum unit period that constitutes a drawing update waiting period PB which is a period for waiting for update of drawing (step S14). For example, in the example shown in (c) of FIG. 7, the minimum unit period is the first drawing update waiting period PB1 (10.00 ms).

Note that, as shown in (b) of FIG. 7, in a case where the drawing update waiting period PB is not divided into a plurality of minimum unit periods, the minimum unit period constituting the drawing update waiting period PB is the drawing update waiting period PB.

Next, during the minimum unit period, the drawing control section 23 determines whether or not a drawing update request has been made by the host control section 1 or the like (step S14A). In a case where the drawing control section 23 has determined, during the minimum unit period, that a drawing update request has been made by the host control section 1 or the like in the step S14A (Yes in step S14A), the drawing control section 23 causes the period measuring counter 21 to stop counting and proceeds to the step S12 without waiting for the elapse of the minimum unit period. Then, without waiting for the elapse of the minimum unit period, the drawing control section 23 carries out the process of updating drawing (step S12), and carries out the process of the step S13. In the step S14A, in a case where the drawing control section 23 has determined, during the minimum unit period, that no drawing update request has been made by the host control section 1 or the like (No in step S14A), the process proceeds to the step S15, and further proceeds to No in the step S16, No in the step S17, and to the step S18.

In the step S18, the drawing control section 23 sets, after the elapse of the minimum unit period during which no drawing update request has been made, a minimum unit period that constitutes a drawing update waiting period PB which is a period for waiting for update of drawing. For example, in the example shown in (c) of FIG. 7, the minimum unit period is the second drawing update waiting period PB2 (8.33 ms). Note that, as shown in (b) of FIG. 7, in a case where the drawing update waiting period PB is not divided into a plurality of minimum unit periods, the minimum unit period constituting the drawing update waiting period PB is the drawing update waiting period PB.

Next, during the minimum unit period, the drawing control section 23 determines whether or not a drawing update request has been made by the host control section 1 or the like (step S18A). In a case where the drawing control section 23 has determined, during the minimum unit period, that a drawing update request has been made by the host control section 1 or the like in the step S18A (Yes in step S18A), the drawing control section 23 causes the period measuring counter 21 to stop counting and proceeds to the step S12 without waiting for the elapse of the minimum unit period. Then, without waiting for the elapse of the minimum unit period, the drawing control section 23 carries out the process of updating drawing (step S12), and carries out the process of the step S13. In the step S18A, in a case where the drawing control section 23 has determined, during the minimum unit period, that no drawing update request has been made by the host control section 1 or the like (No in step S18A), the process proceeds to the step S19, and then returns to the step S16.

Thus, as shown in the steps S14A and S18A in Embodiment 2, in a case where any interrupt process has been carried out in the minimum unit period, the drawing control section 23 carries out the process of updating drawing without waiting for the elapse of the minimum unit period during which the interrupt process has been carried out.

From this, the drawing control section 23 can carry out the process of updating drawing quickly after the interrupt process has been carried out.

[Example of Configuration Achieved by Software]

The control blocks (in particular, the drawing control section 23) of the display control section 3 can be realized by a logic circuit (hardware) provided in an integrated circuit (IC chip) or the like or can be alternatively realized by software.

In the latter case, the display control section 3 includes a computer that executes instructions of a program that is software realizing the foregoing functions. The computer includes, for example, at least one processor (control device) and at least one computer-readable storage medium storing the program. In a case where the processor in the computer reads out the program from the storage medium and executes the program, the object of the present invention is achieved. The processor can be, for example, a central processing unit (CPU). The storage medium can be a "non-transitory tangible medium" such as, for example, a tape, a disk, a card, a semiconductor memory, a programmable logic circuit, or the like, as well as a read only memory (ROM) or the like. The computer can further include a random access memory (RAM) in which the program is loaded. The program can be supplied to or made available to the computer via any transmission medium (such as a communication network or a broadcast wave) that can transmit the program. Note that an aspect of the present invention can also be achieved in the form of a computer data signal in which the program is embodied via electronic transmission and which is embedded in a carrier wave.

[Recap]

The display control device in accordance with an aspect 1 of the present invention is a display control device for controlling a display panel which displays an image that is contained in content and is drawn, the display control device including: a drawing control section that sets a first drawing period and a drawing update waiting period, the first drawing period being a period during which the image is drawn, and the drawing update waiting period being a period following the first drawing period and being a period for waiting for update of drawing of the image, the drawing control section setting the first drawing period and the drawing update waiting period so that the first drawing period becomes different in length from the drawing update waiting period and, a frame interval of the content matches a combined period of the first drawing period and the drawing update waiting period.

According to the configuration, the combined period of the first drawing period and the drawing update waiting period matches the frame interval of the content. Therefore, it is possible to prevent a non-displayed image (called a dropped frame) which is caused by a disagreement between the frame interval of the content to be reproduced and the driving interval of the display panel. Consequently, it is possible to prevent a deterioration in display quality.

In addition, according to the configuration, the drawing control section can check, after the elapse of each of the first drawing period and the drawing update waiting period each of which is a period shorter than the frame interval of the content, whether or not a drawing update request has been made. From this, the drawing control section sets can carry out update of drawing quickly after receipt of the drawing update request.

That is, according to the configuration, it is possible to provide the display control device that (i) prevents a deterioration in display quality caused by a disagreement between a frame interval of content and an interval for updating drawing, and (ii) carries out update of drawing quickly after receipt of a drawing update request.

According to the display control device in accordance with an aspect 2 of the present invention, it is possible in the aspect 1 that, in a case where the drawing control section has not received a drawing update request during the first drawing period, the drawing control section sets the drawing update waiting period that follows the first drawing period; and in a case where the drawing control section has received a drawing update request during the first drawing period, the drawing control section sets a second drawing period that follows the first drawing period and has a length identical with that of the first drawing period.

According to the configuration, in a case where the drawing control section has received no drawing update request during the first drawing period, the drawing control section sets the drawing update waiting period so that the drawing update waiting period matches the frame interval of the content. From this, it is possible to prevent a disagreement between the frame interval of the content and the interval for updating the drawing. In a case where the drawing control section has received a drawing update request during the first drawing period, the drawing control section sets a second drawing period following the first drawing period, and this makes it possible to carry out update of drawing quickly after receipt of the drawing update request.

According to the display control device in accordance with an aspect 3 of the present invention, it is possible in the aspect 1 or 2 that, in a case where the drawing control section has received a drawing update request during the drawing update waiting period, the drawing control section sets a second drawing period that follows the drawing update waiting period and has a length identical with that of the first drawing period. According to the configuration, in a case where the drawing control section has received a drawing update request during the drawing update waiting period, the drawing control section sets the second drawing period following the drawing update waiting period, and this makes it possible to carry out update of drawing quickly after receipt of the drawing update request.

According to the display control device in accordance with an aspect 4 of the present invention, it is possible in the aspects 1 through 3 that the drawing update waiting period includes a plurality of successive periods. According to the configuration, the drawing control section can check, after the elapse of each of the plurality of periods, whether or not a drawing update request has been made. This allows the display panel to carry out update of drawing more quickly.

According to the display control device in accordance with an aspect 5 of the present invention, it is preferable in the aspect 4 that, in a case where the plurality of successive periods have been set a predetermined number of times, the drawing control section sets a second drawing period that follows the plurality of successive periods and has a length identical with that of the first drawing period. This allows the image on the display panel to be updated at a minimally needed refresh rate. Consequently, it is possible to prevent a deterioration in display quality of the image on the display panel.

According to the display control device in accordance with an aspect 6 of the present invention, it is possible in the aspect 4 or 5 that the drawing update waiting period includes a first drawing update waiting period and a second drawing update waiting period which are the plurality of successive periods and respectively have different lengths. By thus constituting the drawing update waiting period by the combination of the first drawing update waiting period and the second drawing update waiting period, various periods can be combined so as to match with the frame interval of content. Therefore, it is possible to increase variations of periods to be combined.

According to the display control device in accordance with an aspect 7 of the present invention, it is possible in the aspect 6 that the drawing update waiting period further includes a third drawing update waiting period which is included in the plurality of successive periods, follows the second drawing update waiting period, and has a length identical with that of the second drawing update waiting period. By thus constituting the drawing update waiting period by the combination of the first drawing update waiting period, the second drawing update waiting period, and the third drawing update waiting period, various periods can be combined so as to match with the frame interval of content. Therefore, it is possible to further increase variations of periods to be combined.

According to the display control device in accordance with an aspect 8 of the present invention, it is possible in the aspect 7 that a combined period of the first drawing period and the first drawing update waiting period is identical in length with a combined period of the second drawing update waiting period and the third drawing update waiting period.

According to the configuration, the drawing control section sets the first drawing update waiting period for the first drawing period such that the combined period of the first drawing period and the first drawing update waiting period becomes twice the length (e.g., 16.67 ms) of the period (e.g., 8.33 ms), which is commonly used as a driving period of a display panel. Thus, each of the second drawing update waiting period and the third drawing update waiting period can be set to a period (e.g., 8.33 ms) that has actually been commonly used as a driving period of a display panel. As a result, the display control device can drive the display panel while inhibiting generation of a malfunction.

According to the display control device in accordance with an aspect 9 of the present invention, it is possible in the aspects 6 through 8 that a reciprocal number of a combined period of the first drawing period and the first drawing update waiting period is 60 Hz. By setting the first drawing update waiting period as in the above configuration, the drawing control section can set the reciprocal number of the combined period of the first drawing period and the first drawing update waiting period to be a frequency (60 Hz), which has actually been commonly used as a driving frequency of a display panel. As a result, the display control device can drive the display panel while inhibiting generation of a malfunction.

According to the display control device in accordance with an aspect 10 of the present invention, it is possible in the aspect 7 or 8 that a reciprocal number of a combined period of the first drawing period, the first drawing update waiting period, the second drawing update waiting period, and the third drawing update waiting period is 30 Hz. According to the configuration, the reciprocal number can be set to be a frequency (30 Hz), which has actually been commonly used as a driving frequency of a display panel. As a result, the display control device can drive the display panel while inhibiting generation of a malfunction.

According to the display control device in accordance with an aspect 11 of the present invention, it is possible in the aspects 2, 3, and 5 that, in the second drawing period, an image is drawn which is identical with an image drawn in the first drawing period or an image is drawn which is for a frame following the image drawn in the first drawing period. This allows the display panel to be refreshed in the second drawing period that follows the first drawing period.

The display device in accordance with an aspect 12 of the present invention can include, in the aspects 1 through 11, the display control device and the display panel. According to the configuration, it is possible to provide the display device that (i) prevents a deterioration in display quality caused by a disagreement between a frame interval of content and an interval for updating drawing, and (ii) carries out update of drawing quickly after receipt of a drawing update request.

The display control method in accordance with an aspect 13 of the present invention is a method for causing a display control device to control a display panel which displays an image that is contained in content and is drawn, the method including: a drawing control step of setting a first drawing period and a drawing update waiting period, the first drawing period being a period during which the image is drawn, and the drawing update waiting period being a period following the first drawing period and being a period for waiting for update of drawing of the image, in the drawing control step, the first drawing period and the drawing update waiting period being set so that the first drawing period becomes different in length from the drawing update waiting period, and a frame interval of the content matches a combined period of the first drawing period and the drawing update waiting period. According to the configuration, it is possible to provide the display control method that (i) prevents a deterioration in display quality caused by a disagreement between a frame interval of content and an interval for updating drawing, and (ii) carries out update of drawing quickly after receipt of a drawing update request.

The present invention is not limited to the embodiments, but can be altered by a skilled person in the art within the scope of the claims. The present invention also encompasses, in its technical scope, any embodiment derived by combining technical means disclosed in differing embodiments. Further, it is possible to form a new technical feature by combining the technical means disclosed in the respective embodiments.

REFERENCE SIGNS LIST

1: Host control section
2: Display panel
3: Display control section (display control device)
10: Memory
20: TG
21: Period measuring counter
22: Waiting number counter
23: Drawing control section
100: Display device
PA1: First drawing period
PA2: Second drawing period
PB: Drawing update waiting period
PB1: First drawing update waiting period
PB2: Second drawing update waiting period
PB3: Third drawing update waiting period

The invention claimed is:

1. A display control device for controlling a display panel which displays a video image that is contained in pieces of content at different frame frequencies and is drawn, said display control device comprising:

a drawing control section that sets a first drawing period, the first drawing period being a period during which the video image is drawn, in a case where the drawing control section has not received a first drawing update request during the first drawing period, the drawing control section setting a drawing update waiting period, the drawing update waiting period being a period following the first drawing period and being a period for waiting until update of next drawing of the video image, the drawing control section setting a length of the first drawing period and a length of the drawing update waiting period so that the first drawing period becomes different in length from the drawing update waiting period, and a frame interval of a piece of content that is displayed from among the pieces of content at different frame frequencies matches a combined period of the first drawing period and the drawing update waiting period.

2. The display control device as set forth in claim 1, wherein:

in a case where the drawing control section has received a second drawing update request during the first drawing period, the drawing control section sets a second drawing period that follows the first drawing period and has a length identical to a length of the first drawing period.

3. The display control device as set forth in claim 2, wherein:

in the second drawing period, a video image is drawn which is identical with a video image drawn in the first drawing period or a video image is drawn which is for a frame following the video image drawn in the first drawing period.

4. The display control device as set forth in claim 1, wherein:

in a case where the drawing control section has received a second drawing update request during the drawing update waiting period, the drawing control section sets a second drawing period that follows the drawing update waiting period and has a length identical to a length of the first drawing period.

5. The display control device as set forth in claim 1, wherein the drawing update waiting period includes a plurality of successive periods.

6. The display control device as set forth in claim 5, wherein:

in a case where the plurality of successive periods have been set a predetermined number of times, the drawing control section sets a second drawing period that follows the plurality of successive periods and has a length identical to a length of the first drawing period.

7. The display control device as set forth in claim 5, wherein:

the drawing update waiting period includes a first drawing update waiting period and a second drawing update waiting period which are the plurality of successive periods and respectively have different lengths.

8. The display control device as set forth in claim 7, wherein:

the drawing update waiting period further includes a third drawing update waiting period which is included in the plurality of successive periods, follows the second drawing update waiting period, and has a length identical to a length of the second drawing update waiting period.

9. A display device comprising the display control device and the display panel which are recited in claim 1.

10. A display control device for controlling a display panel which displays a video image that is contained in pieces of content at different frame frequencies and is drawn, said display control device comprising:

a drawing control section that sets a first drawing period, the first drawing period being a period during which the video image is drawn, in a case where the drawing control section has not received a first drawing update request during the first drawing period, the drawing control section setting a drawing update waiting period, the drawing update waiting period being a period following the first drawing period and being a period for waiting until update of next drawing of the video image, the drawing control section setting a length of the first drawing period and a length of the drawing update waiting period so that the first drawing period becomes different in length from the drawing update waiting period, and a frame interval of a piece of content that is displayed from among the pieces of content at different frame frequencies matches a combined period of the first drawing period and the drawing update waiting period;

wherein:

the drawing update waiting period includes a plurality of successive periods;

the drawing update waiting period includes a first drawing update waiting period and a second drawing update waiting period which are the plurality of successive periods and respectively have different lengths;

the drawing update waiting period further includes a third drawing update waiting period which is included in the plurality of successive periods, follows the second drawing update waiting period, and has a length identical to a length of the second drawing update waiting period; and a combined period of the first drawing period and the first drawing update waiting period is identical in length with a combined period of the second drawing update waiting period and the third drawing update waiting period.

11. A display control device for controlling a display panel which displays a video image that is contained in pieces of content at different frame frequencies and is drawn, said display control device comprising:

a drawing control section that sets a first drawing period, the first drawing period being a period during which the video image is drawn, in a case where the drawing control section has not received a first drawing update request during the first drawing period, the drawing control section setting a drawing update waiting period, the drawing update waiting period being a period following the first drawing period and being a period for waiting until update of next drawing of the video image, the drawing control section setting a length of the first drawing period and a length of the drawing update waiting period so that the first drawing period becomes different in length from the drawing update waiting period, and a frame interval of a piece of content that is displayed from among the pieces of content at different frame frequencies matches a combined period of the first drawing period and the drawing update waiting period;

wherein:

the drawing update waiting period includes a plurality of successive periods;

the drawing update waiting period includes a first drawing update waiting period and a second drawing update waiting period which are the plurality of successive periods and respectively have different lengths; and a reciprocal number of a combined period of the first drawing period and the first drawing update waiting period is 60 Hz.

12. A display control device for controlling a display panel which displays a video image that is contained in pieces of content at different frame frequencies and is drawn, said display control device comprising:

a drawing control section that sets a first drawing period, the first drawing period being a period during which the video image is drawn, in a case where the drawing control section has not received a first drawing update request during the first drawing period, the drawing control section setting a drawing update waiting period, the drawing update waiting period being a period following the first drawing period and being a period for waiting until update of next drawing of the video image, the drawing control section setting a length of the first drawing period and a length of the drawing update waiting period so that the first drawing period becomes different in length from the drawing update waiting period, and a frame interval of a piece of content that is displayed from among the pieces of content at different frame frequencies matches a combined period of the first drawing period and the drawing update waiting period;

wherein:

the drawing update waiting period includes a plurality of successive periods;

the drawing update waiting period includes a first drawing update waiting period and a second drawing update waiting period which are the plurality of successive periods and respectively have different lengths; and a reciprocal number of a combined period of the first drawing period, the first drawing update waiting period, the second drawing update waiting period, and the third drawing update waiting period is 30 Hz.

13. A method for causing a display control device to control a display panel which displays a video image that is contained in pieces of content at different frame frequencies and is drawn, said method comprising:

a drawing control step of setting a first drawing period, the first drawing period being a period during which the video image is drawn in the drawing control step, in a case where a drawing update request has not received during the first drawing period, a drawing update waiting period being set, the drawing update waiting period being a period following the first drawing period and being a period for waiting until update of next drawing of the video image, in the drawing control step, a length of the first drawing period and a length of the drawing update waiting period being set so that the first drawing period becomes different in length from the drawing update waiting period, and a frame interval of a piece of content that is displayed from among the pieces of content at different frame frequencies matches a combined period of the first drawing period and the drawing update waiting period.

* * * * *